US005297500A

United States Patent [19]

Wilson

[11] Patent Number: 5,297,500

[45] Date of Patent: Mar. 29, 1994

[54] APPARATUS FOR ASSISTING IN PARKING VEHICLES IN A VEHICLE SHELTER

[76] Inventor: Stanley B. Wilson, Rte. 2, Box 107, Gibbon, Nebr. 68840

[21] Appl. No.: 10,698

[22] Filed: Jan. 29, 1993

[51] Int. Cl.[5] ..... B60S 13/00

[52] U.S. Cl. ..... 116/28 R; 24/115 H

[58] Field of Search ..... 116/28 R; 24/115 H, 24/129 A, 306, 616; 248/328

[56] References Cited

U.S. PATENT DOCUMENTS

| | | | |
|---|---|---|---|
| 807,100 | 12/1905 | Wood | 248/328 |
| 823,594 | 6/1906 | Frazee | 248/328 |
| 2,145,142 | 1/1939 | Stout | 248/328 |
| 2,204,947 | 6/1940 | Apfelbaum | 24/115 H |
| 2,854,942 | 10/1958 | Ross | 116/28 R |
| 3,793,981 | 2/1974 | Sparks | 116/28 R |
| 3,844,050 | 10/1974 | Lynn | 116/28 R X |
| 3,851,357 | 12/1974 | Ribich et al. | 24/306 |
| 5,050,276 | 9/1991 | Pemberton | 24/616 X |

*Primary Examiner*—William A. Cuchlinski, Jr.
*Assistant Examiner*—Willie Morris Worth
*Attorney, Agent, or Firm*—Henderson & Sturm

[57] ABSTRACT

An apparatus for assisting in correctly positioning a vehicle in a shelter having an adjustable length line which includes ceiling and indicator attachment ends. Also included is a ceiling fastener adapted to be secured to a ceiling surface, a ceiling attachment for removably securing the line ceiling attachment end to the ceiling fastener, an indicator, an indicator fastener adapted to be secured to the indicator, and an indicator attachment for removably securing the line indicator attachment end to the indicator fastener such that the apparatus may be adjustably suspended from the ceiling of a vehicle shelter whereby the operator of a vehicle may utilize the location of the suspended indicator to selectively park the vehicle in an appropriate location within the vehicle shelter.

2 Claims, 3 Drawing Sheets

APPARATUS FOR ASSISTING IN PARKING VEHICLES IN A VEHICLE SHELTER

TECHNICAL FIELD

The present invention is related to an apparatus for assisting in parking vehicles in a vehicle shelter and more particularly to improvements therein wherein both adjustment means are provided for easily modifying the device such that it may be utilized with most vehicles in most vehicle shelters, and wherein safety releases are also provided such that the device may be safely utilized in areas frequented by young children.

DESCRIPTION OF THE PRIOR ART

Most homes include a shelter for parking vehicles. These shelters include parking areas for one or more vehicles. In operation, the driver of a vehicle causes the garage door of a particular parking area to open, the driver then maneuvers the vehicle into the parking area such as to avoid any obstacles. The driver must also be concerned with parking position. Should the vehicle not be situated properly the garage door may strike the bumper or rear deck during the closing operation of the garage door. Likewise, should the vehicle be pulled ahead too far individuals and passengers may have difficulty exiting the vehicle. Given these factors, it is often difficult to judge the appropriate location within a parking area to park a car.

This problem is compounded by the fact that most homeowners utilize their garages to store other vehicle related and nonvehicle related items. These items form additional obstacles which reduce any available margin of error such that it may be extremely difficult to park the vehicle both safely and comfortably.

Known to the art are certain tire restraints which are utilized to locate an optimum parking position within a parking area or the like. Commonly, bags of sand are laid upon the garage floor at a point just adjacent the location of where the vehicle's front tires are desired. Such restraints or obstacles are an eyesore and form a tripping hazard.

Also known is the use of a tennis ball or the like suspended from a garage ceiling. Such devices are difficult to install and create an attractive nuisance for children who find it difficult to refrain from batting the suspended ball about. Such activity is dangerous and will soon require the device to be repaired and/or reinstalled.

Thus, it is a principle object of the present invention to provide an improved apparatus for assisting in correctly positioning a vehicle in a shelter.

Another object of the present invention is to provide an apparatus for assisting in correctly positioning a vehicle in a shelter which is easy to install.

Another object of the present invention is to provide an apparatus for assisting in correctly positioning a vehicle in a shelter which may be adapted for use with any vehicle within any shelter.

Another object of the present invention is to provide an apparatus for assisting in correctly positioning a vehicle in a shelter which provides fasteners or couplers of different strengths such that the indicator ball may be removed from the line more easily than the line may be removed from the ceiling such that the device may be safely used in areas frequented by children.

Another object of the present invention is to provide an apparatus for assisting in correctly positioning a vehicle in a shelter which is attractive and durable in construction.

Another object of the present invention is to provide an apparatus for assisting in correctly positioning a vehicle in a shelter which is easy to manufacture.

SUMMARY OF THE INVENTION

The present invention accomplishes at least all of the before stated objects by teaching a novel apparatus for assisting in correctly positioning a vehicle in a shelter. In a preferred embodiment the present invention includes: (1) an adjustable length line which includes ceiling and indicator attachment ends; (2) a ceiling fastener adapted to be secured to a ceiling surface; (3) a ceiling attachment for removably securing the line ceiling attachment end to the ceiling fastener; (4) an indicator mass; (5) an indicator fastener adapted to be secured to the indicator mass; and (6) an indicator mass attachment for removably securing the line indicator attachment end to the indicator fastener such that the apparatus may be adjustably suspended from the ceiling of a vehicle shelter whereby the operator of a vehicle may utilize the location of the suspended indicator mass to selectively park the vehicle in an appropriate location within the vehicle shelter. In a preferred embodiment it is desired that the fastener closest to the ceiling is strongest.

DETAILED DESCRIPTION OF THE DRAWINGS

BEST MODE FOR CARRYING OUT THE INVENTION

Figure 1:
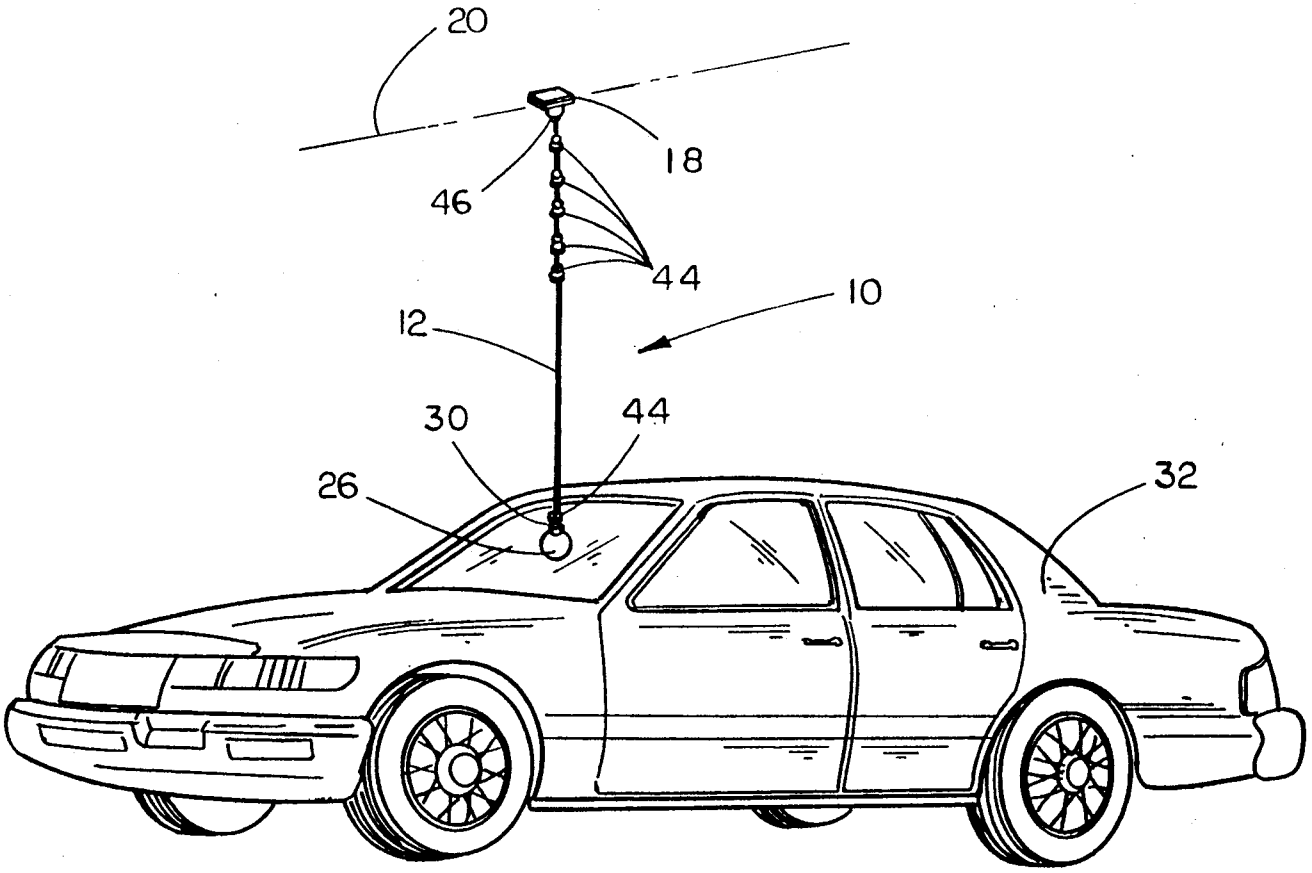
FIG. 1 is a perspective view of a first preferred embodiment of the present invention illustrating the invention in use.
Figure 2:
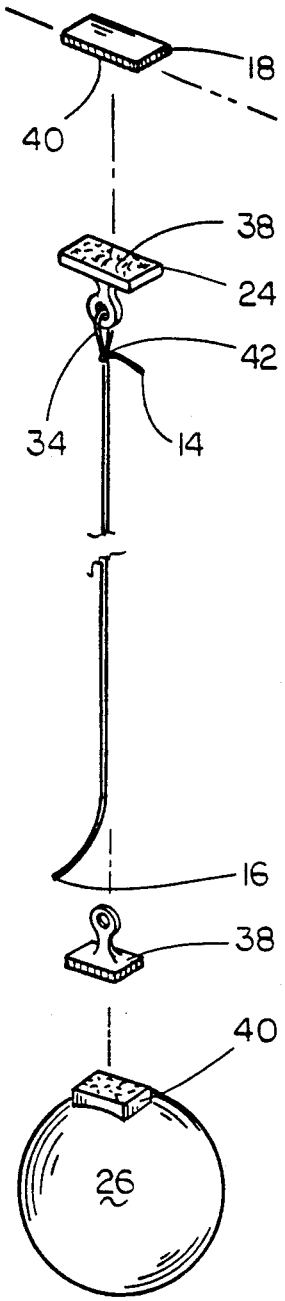
FIG. 2 is a perspective exploded view of a second preferred embodiment of the present invention illustrating the various components of such an embodiment.
Figure 3:
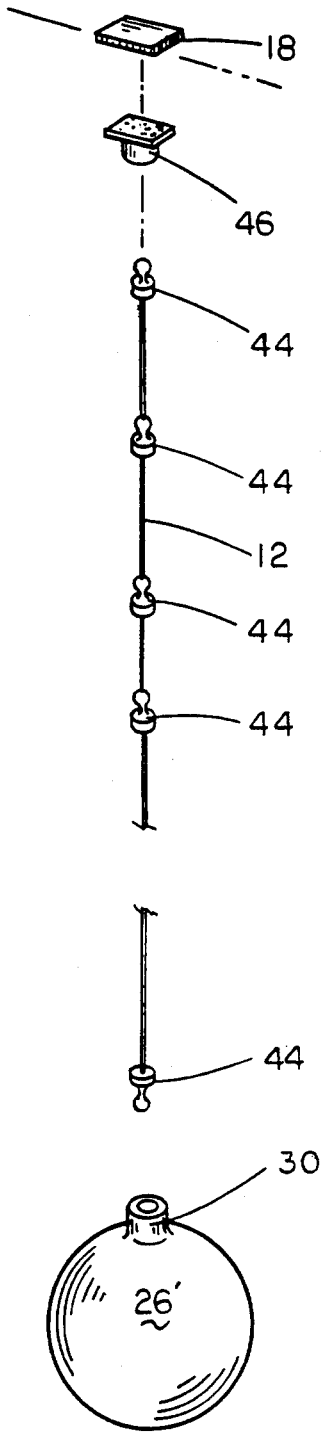
FIG. 3 is a perspective partially exploded view of the first preferred embodiment of the present invention illustrating the various components of such an embodiment.
Figure 4:
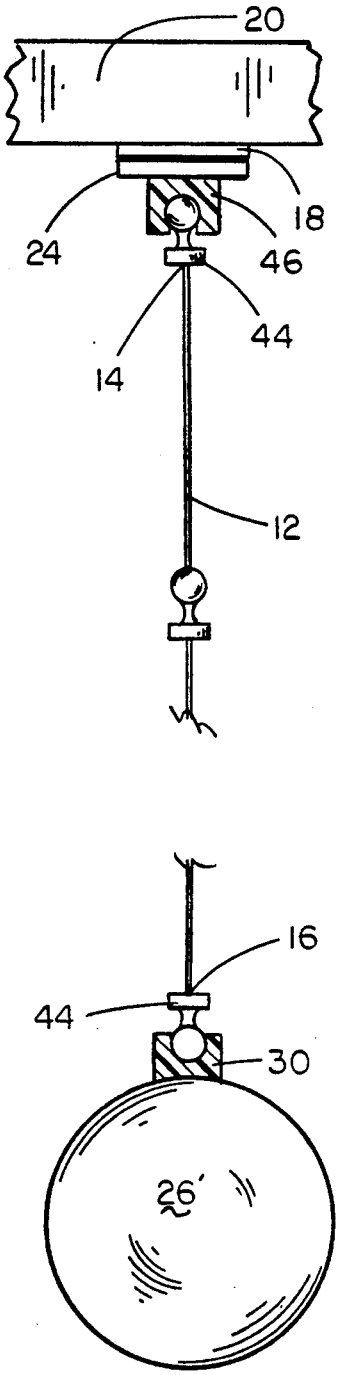
FIG. 4 is a cross-sectional elevational view of the first preferred embodiment of the present invention illustrating the operation of the fasteners and line adjustment means.

A first preferred embodiment of the present invention is illustrated in FIGS. 1, 3, 4, and 5. Turning first to FIG. 1, wherein there is illustrated a first preferred embodiment of the present invention 10, the apparatus includes an adjustable length line 12 having ceiling and indicator attachment ends (14, 16; FIG. 4). In a preferred embodiment the line 12 is fabricated from a multifilament polymer. Additionally, so that the line 12 length may be adjusted, it is preferred to attach a plurality of spaced apart male friction snap ends 44 (FIGS. 1, 3, and 5) such that the length of the line 12 may be adjusted to accommodate different vehicles and shelters by simply cutting off excess lengths of line 12 up to the appropriate male snap end 44.

Figure 5:
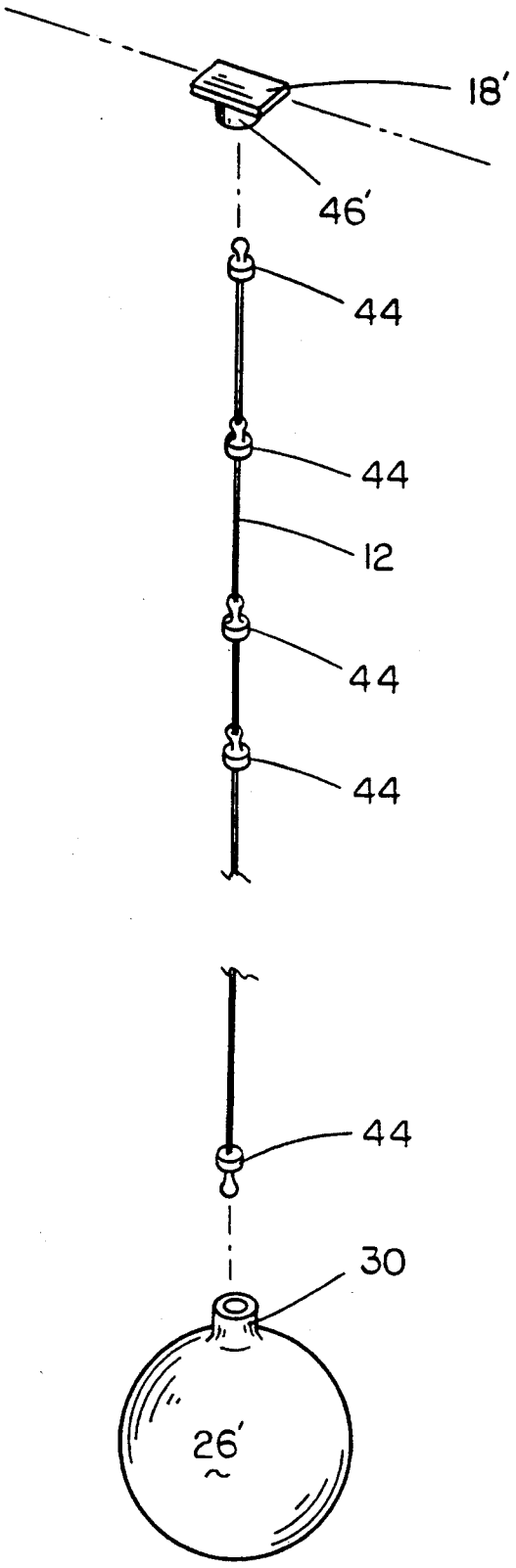
FIG. 5 is a perspective partially exploded view of a third preferred embodiment of the present invention illustrating the various components of such embodiment.

Turning now to FIG. 3, wherein an exploded view of the apparatus 10 is illustrated, there is shown a ceiling fastener 18 adapted to be secured to drywall, rafters, or the like via conventional ceiling fastening means. The surface of the fastener 18 not secured to the ceiling 20 may contain a magnet adapted to attract a magnet contained in a ceiling attachment means (24, 46). Likewise, the fastener 18 may be removably secured to the ceiling attachment means via a conventional hook and loop fastener consisting of a hook portion surface 38 and a loop portion surface 40. As is illustrated best in FIG. 3, the ceiling attachment means provides a female friction snap end 46 for removably securing the line 12 to the ceiling 20. Likewise, an indicator mass, preferably formed from a ball or the like 26, may be removably secured to the indicator attachment end 16 of the line 12 as described herein via an indicator mass attachment means 30 (FIG. 3 FIG. 4 and FIG. 5).

It is preferred that the indicator mass 26 be more easily removed from the line 12 than the indicator mass 26 and line 12 combination. This may be accomplished by utilizing fasteners of different strengths at either end of the line 12. For example, the hook and loop fastener (38, 40) may be smaller at the indicator attachment end 16 of the line 12. In this fashion the apparatus may be made such that the ball 26 detaches from the line 12 if it is banged about somewhat aggressively and that the line 12 only detaches from the ceiling 20 where the line 12 is pulled upon aggressively.

Whereas, the invention has been described in connection with preferred embodiments thereof, it is apparent that many additions, modifications and substitutions may be made which are within the intended broad scope of the appended claims. Thus, there has been shown and described an improved apparatus for assisting in correctly positioning a vehicle in a shelter which accomplishes at least all of the before stated objects.

I claim:

1. An apparatus for visually positioning a vehicle in a shelter having a ceiling surface; wherein, the apparatus comprises:

an adjustable length line having ceiling and indicator attachment ends;

a ceiling fastener adapted to be secured to a ceiling surface;

ceiling attachment means for removable securing said line ceiling attachment end to said ceiling fastener;

an indicator mass;

an indicator fastener secured to said indicator mass;

indicator mass attachment means for removable securing said line indicator attachment end to said indicator fastener such that said indicator mass may be adjustably suspended from the ceiling fastener of a vehicle shelter whereby the operator of a vehicle may utilize the location of said suspended indicator mass to selectively park the vehicle in an appropriate location within said vehicle shelter; and, releasable coupling means operatively associated with said ceiling and mass attachment means for releasing the indicator mass from the ceiling fastener upon the application of a certain amount of force.

2. The apparatus as in claim 1 wherein, said releasable coupling means comprises two pairs of couplers; wherein, a first pair of couplers is operatively associated with said ceiling fastener, a second pair of couplers is operatively associated with the indicator mass; and, wherein the amount of force required to separate the first pair of couplers from one another is greater than the amount of force required to separate the second pair of couplers from one another.

* * * * *